US008302760B2

(12) United States Patent
Cuypers

(10) Patent No.: US 8,302,760 B2
(45) Date of Patent: Nov. 6, 2012

(54) TRANSFER DEVICE FOR CANDY OR CONFECTIONERY

(75) Inventor: Leonardus Hermanus Maria Cuypers, Ell (NL)

(73) Assignee: CFS Weert B.V., Weert (NL)

( * ) Notice: Subject to any disclaimer, the term of this patent is extended or adjusted under 35 U.S.C. 154(b) by 938 days.

(21) Appl. No.: 11/659,303

(22) PCT Filed: Aug. 4, 2005

(86) PCT No.: PCT/NL2005/000572
§ 371 (c)(1),
(2), (4) Date: Nov. 23, 2009

(87) PCT Pub. No.: WO2006/014108
PCT Pub. Date: Feb. 9, 2006

(65) Prior Publication Data

US 2010/0059332 A1 Mar. 11, 2010

(30) Foreign Application Priority Data

Aug. 4, 2004 (NL) ..... 1026780

(51) Int. Cl.
*B65B 25/00* (2006.01)

(52) U.S. Cl. ..... 198/470.1; 198/867.05

(58) Field of Classification Search ..... 198/348, 198/470.1, 476.1, 482.1, 867.05, 867.07, 198/867.11; 209/2, 617; 53/234, 370, 594
See application file for complete search history.

(56) References Cited

U.S. PATENT DOCUMENTS

| | | | | | |
|---|---|---|---|---|---|
| 2,681,624 | A | * | 6/1954 | Sergent | 53/134.1 |
| 2,705,857 | A | * | 4/1955 | Fox et al. | 53/397 |
| 3,987,605 | A | * | 10/1976 | Johnson | 53/234 |
| 4,008,812 | A | * | 2/1977 | Stuart | 198/444 |
| 4,024,058 | A | * | 5/1977 | Derckx | 209/625 |
| 5,442,894 | A | * | 8/1995 | Ogata et al. | 53/234 |
| 5,450,706 | A | * | 9/1995 | Latini | 53/397 |
| 5,490,368 | A | * | 2/1996 | Spatafora | 53/234 |
| 5,493,847 | A | * | 2/1996 | Spatafora | 53/461 |
| 7,730,699 | B2 | * | 6/2010 | Asma | 53/594 |
| 7,739,860 | B2 | * | 6/2010 | Van Rens | 53/466 |
| 8,020,690 | B2 | * | 9/2011 | Asma | 198/470.1 |

FOREIGN PATENT DOCUMENTS

| | | | |
|---|---|---|---|
| EP | 1 041 005 | A1 | 10/2000 |
| EP | 1 283 183 | B1 | 2/2003 |
| WO | WO 03/043436 | A1 | 5/2003 |
| WO | WO 2005/014448 | A1 | 2/2005 |

OTHER PUBLICATIONS

International Search Report for PCT/NL2005/000572, date of mailing. Nov. 10, 2005, 3 pages.

* cited by examiner

*Primary Examiner* — Douglas Hess
(74) *Attorney, Agent, or Firm* — Foley & Lardner LLP

(57) ABSTRACT

Device (6) for transferring candy articles, in particular lollipops provided with a stick, from a feed location to an exit location spaced apart therefrom, comprising at least one conveyor with candy article holders (23*a*, 23*b*), wherein the device is provided with first operation means for at the location of a reception location (H) at the conveyor setting candy article holders in a receiving position for receiving a stick coming from the feed location and with second operation means for at the location of a discharge location (I) at the conveyor setting the candy article holders in a discharge position for discharging the stick to the exit location, wherein the device is furthermore provided with third operation means (4) positioned between the reception location and the discharge location for, upstream from the discharge location, setting the candy article holders in a discharge position.

35 Claims, 4 Drawing Sheets

TRANSFER DEVICE FOR CANDY OR CONFECTIONERY

The invention relates to a transfer device for articles to be consumed, of candy or confectionery, in particular for lollipops provided with a stick.

The invention further relates to a packaging device for candy or confectionery articles, in particular lollipops provided with a stick.

After having been manufactured candy, such as lollipops are packaged in a packaging machine, particularly (a lollipop head) being enveloped by foil material. Said packaging takes place by supplying the candy, lollipops, singled, in series to the packaging machine, to which the foil material is also supplied. In order to effect an optimal mutual adjustment of the supplier and the packaging parts, they are driven by a central motor.

In case of an emergency stop of the machine the entire machine has to be stopped for safety reasons. The machine subsequently has to be started again and brought into register again, which requires some time. Also in case of a defect or interruptions in the foil supply or in case of defects in the packaging process the entire machine is stopped. Stopping the machine may also be necessary when the process as such is not running properly, for instance when the foil and the lollipops do not run in register. The sealing heads or sealing jaws used for sealing the packagings however keep emanating heat for a long while after stopping the machine. This may aggravate the defect because the packaging material may namely melt. Plastic lollipop sticks are also susceptible to that, as well as, naturally, the confectionery in the heads. As a result the sealing heads/sealing jaws are contaminated resulting in the lollipops being badly packaged (and being rejected) and/or the machine coming to an acute standstill, which also entails loss of production.

Waiting until the supply of lollipops stops for lack of supply is not a good option, considering the longer time this may take and the quantity of lollipops that will not be used in that case.

It is an object of the invention to improve on this.

From one aspect the invention provides a device for transferring candy articles, in particular lollipops provided with a stick from a feed location to an exit location spaced apart therefrom, comprising at least one conveyor having article transporters, wherein the device is furthermore provided with ejection means positioned between the feed location and the exit location for removing the articles from the article transporters upstream from the exit location.

With the device according to the invention the supply of candy articles, in particular lollipops may be interrupted and only the candy articles present in the trajectory between the ejector and the exit location, where for instance the packaging machine is positioned, are lost prior to turning off (part of) the machine. It is then possible to quickly empty the machine and repair the defect. The part that is not involved in the defect can remain operative. Starting the machine will therefore be quicker than would be the case when the entire machine had to be started again. It is noted that such an ejector can also be used in other process paths including candy articles, in particular lollipops.

In one embodiment the ejection means in the device according to the invention comprise an actuator which is selectively operable to activate the ejection means when required.

In one embodiment the device comprises several, consecutively placed conveyors, wherein the said conveyor has a reception location and a discharge location, wherein the device is provided with feed means for at the location of the reception location at the conveyor placing a candy article—that may come from the feed location—into the candy article transporters and with exit means for at the location of the discharge location at the conveyor releasing the candy article for discharging the candy article from the candy article transporters for optional further conveyance to the exit location, wherein the ejection means are arranged between the reception location and the discharge location.

The reception location of the said conveyor may be spaced apart from the feed location.

The discharge location of the said conveyor may be spaced apart from the exit location.

The said conveyor may be designed like a circulating driven wheel having candy article transporters arranged thereon at its circumference.

In one embodiment thereof the wheel is provided with notches at its circumference for partially enclosing a lollipop, for instance partially enclosing its stick, as well as with confining means for stopping the lollipop radially to the outside. The ejection means may then be adapted for movement of at least a part of the confining means between a position confining the lollipops and a position releasing the lollipops.

In another embodiment, which is preferred, the candy article transporters are designed like candy article holders that move along with the conveyor.

The feed means may then be designed like first operation means for setting the candy article holders in a receiving position for receiving a candy article and the exit means may be designed like second operation means for setting the candy article holders in a discharge position for discharging the candy article to the exit location, wherein the ejection means are designed like third operation means positioned between the first and the second operation means for, upstream from the second operation means, setting the candy article holders in a discharge/removing position.

The third operation means may be positioned for moving between an operative position extending in the path of movement of the candy article holders and an inoperative position situated outside of said path, so that they do not affect the normal process course.

Preferably the candy article holders are designed like candy article clamps, having first and second clamping arms movable with respect to each other, wherein the first, second and third operation means are or can be operative to move the clamping arms with respect to each other, particularly away from each other, wherein the candy article holders preferably are provided with biasing means for biasing the clamping arms towards each other, wherein the first, second and third operation means preferably are operative counter the biasing means.

In a manner known per se one of the clamping arms of the candy article holders can be fixedly positioned and the other clamping arm can be movable, wherein the third operation means preferably form a run-on surface for the movable clamping arm.

From a further aspect the invention provides a device for transferring candy articles, in particular lollipops provided with a stick, from a feed location to an exit location spaced apart therefrom, comprising at least one conveyor with candy article holders, wherein the device is provided with first operation means for at the location of a reception location at the conveyor setting the candy article holders in a receiving position for receiving a candy article and with second operation means for at the location of a discharge location at the conveyor setting the candy article holders in a discharge position for discharging the candy article, wherein the device is furthermore provided with selectively actuatable third operation means positioned between the reception location and the discharge location for, upstream from the discharge location, setting the candy article holders in a discharge position.

Preferably the third operation means are positioned for moving between an operative position extending in the path of movement of the candy article holders and an inoperative position situated outside of said path. The candy article holders can be designed like candy article clamps, as described above.

In one embodiment the reception location is spaced apart from the feed location, like for instance in an arrangement wherein the said conveyor with ejector is linked between other conveyors. In another arrangement the reception location corresponds with the feed location, so that ejection takes place near the beginning of the transfer process.

In a comparable manner the discharge location may be spaced apart from the exit location or correspond with the exit location.

In a further development of the device according to the invention the candy article transporters as usual are adapted for engaging lollipop sticks so as to take them along. These holders may for instance be stick clamps. Alternatively the lollipop holders may be formed by notches in a rotating transport disk and fixed guides confining the sticks radially to the outside.

In a preferred embodiment the conveyor has a down-going trajectory in its circumferential path between the reception location and the discharge location, wherein the ejection means or the third operation means are positioned to be active at the location of the down-going trajectory, which enhances ejection.

In one embodiment the conveyor is positioned in a series of conveyors. The said conveyor can be placed as second conveyor between a first and a third conveyor, wherein consecutive conveyors are driveable circulating in opposite directions.

The device according to the invention may comprise a distributing/sorting disk having a vertical axis of rotation and positioned at the location of the feed location.

The device according to the invention may comprise a packaging station for enveloping each of the candy articles, in particular lollipops, in particular lollipop heads in respective sheets.

The device according to the invention may comprise a twist head of a packaging machine having a horizontal axis of rotation and positioned at the location of the exit location.

From a further aspect the invention provides a conveyor for conveying candy articles in series from a feed location to a discharge location, the conveyor being provided with a series of candy article transporters, one for each candy article, such as article holders, in particular clamps, that are moved according to a circulation, wherein the candy article transporters are movable between an open position, enabling receipt or release of a candy article, and a confining position, in which the candy article is held for conveying it, the conveyor furthermore being provided with an opener which is selectively operable for consecutively bringing the candy article transporters in the open position for removal of the candy articles when required and otherwise allowing the candy article transporters to remain in their confining position.

In one embodiment, the opener comprises an obstacle that is movable between an inactive position not interfering with the candy article transporters and an active position interfering with the candy article transporters for bringing them in the open position.

In a simple embodiment the opener is stationary with respect to the path followed by the candy article transporters, that means that the opener does not move along.

In one embodiment the conveyor circulates in a substantially vertical plane.

In a simple embodiment, easy to include in a train comprising other conveyors, wherein the candy articles are transferred from the one conveyor to the next conveyor, the conveyor comprises a wheel or disk, on which the candy article transporters have been disposed.

From a further aspect the invention provides a device for transferring lollipops from a feed location to an exit location spaced apart therefrom, comprising at least one conveyor having lollipop holders for in series conveying singled lollipops, wherein the device is furthermore provided with a selectively operable opener, positioned between the feed location and the exit location for upstream from the exit location opening the lollipop holders to remove the lollipops therefrom.

The invention will be elucidated on the basis of an exemplary embodiment shown in the attached drawings, and to be used with lollipops having a head of any composition, including lollipops of which the head contains a pharmaceutically or medicinally active substance, in which drawings.

Figure 1:
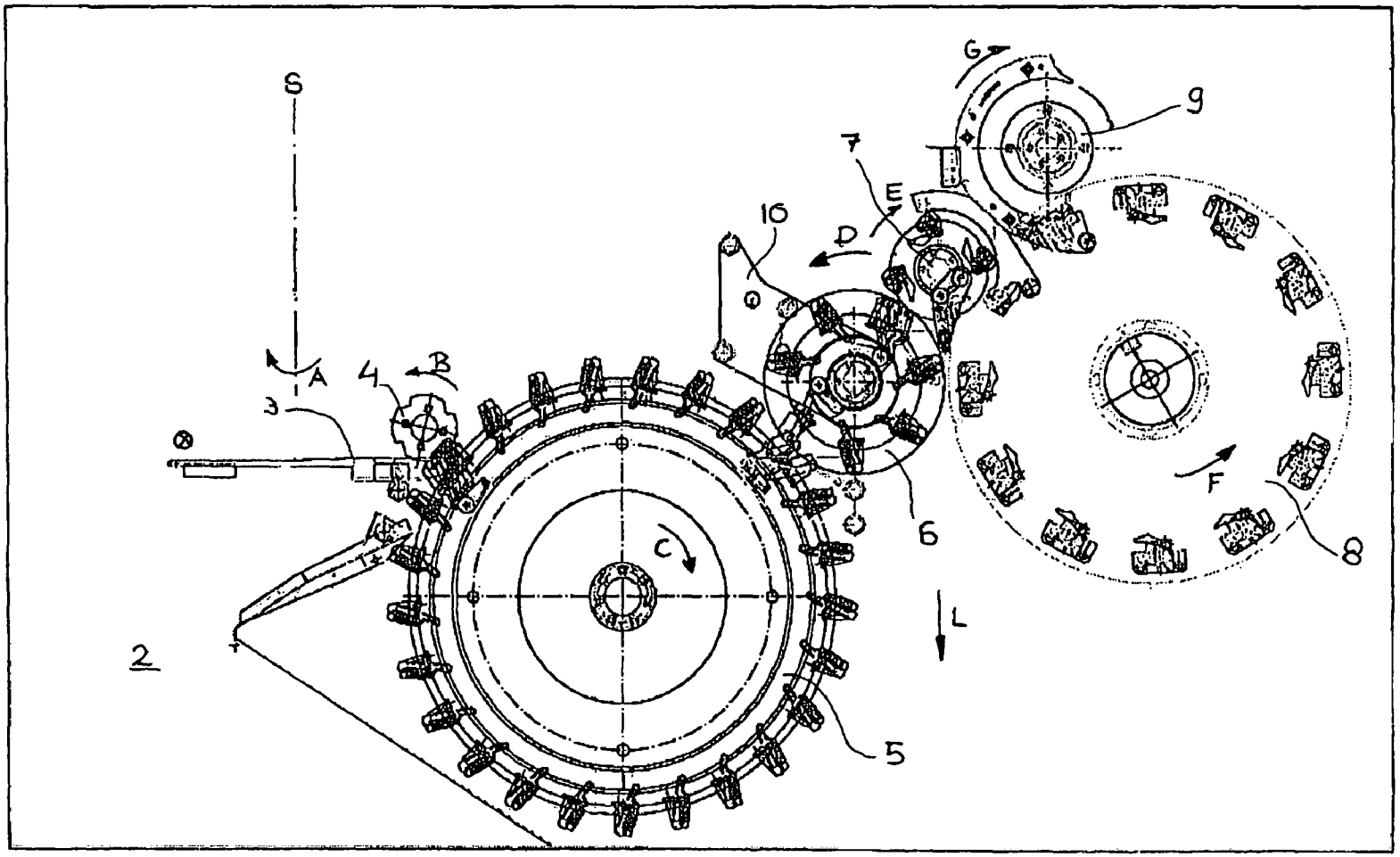
FIG. 1 shows a schematic front view of a device according to the invention, designed like a lollipop packaging device.
Figure 2A:
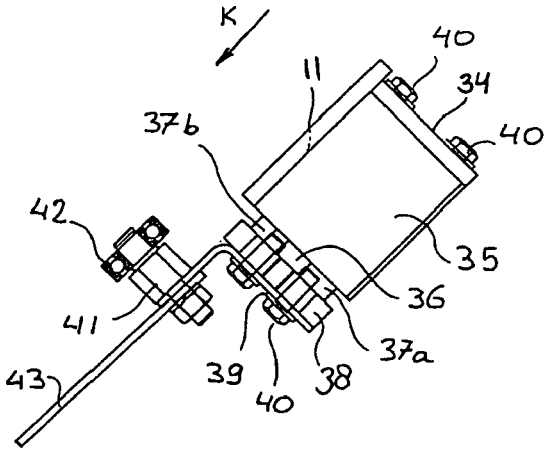
FIG. 2A shows a detail of the part of FIG. 2.
Figure 2:
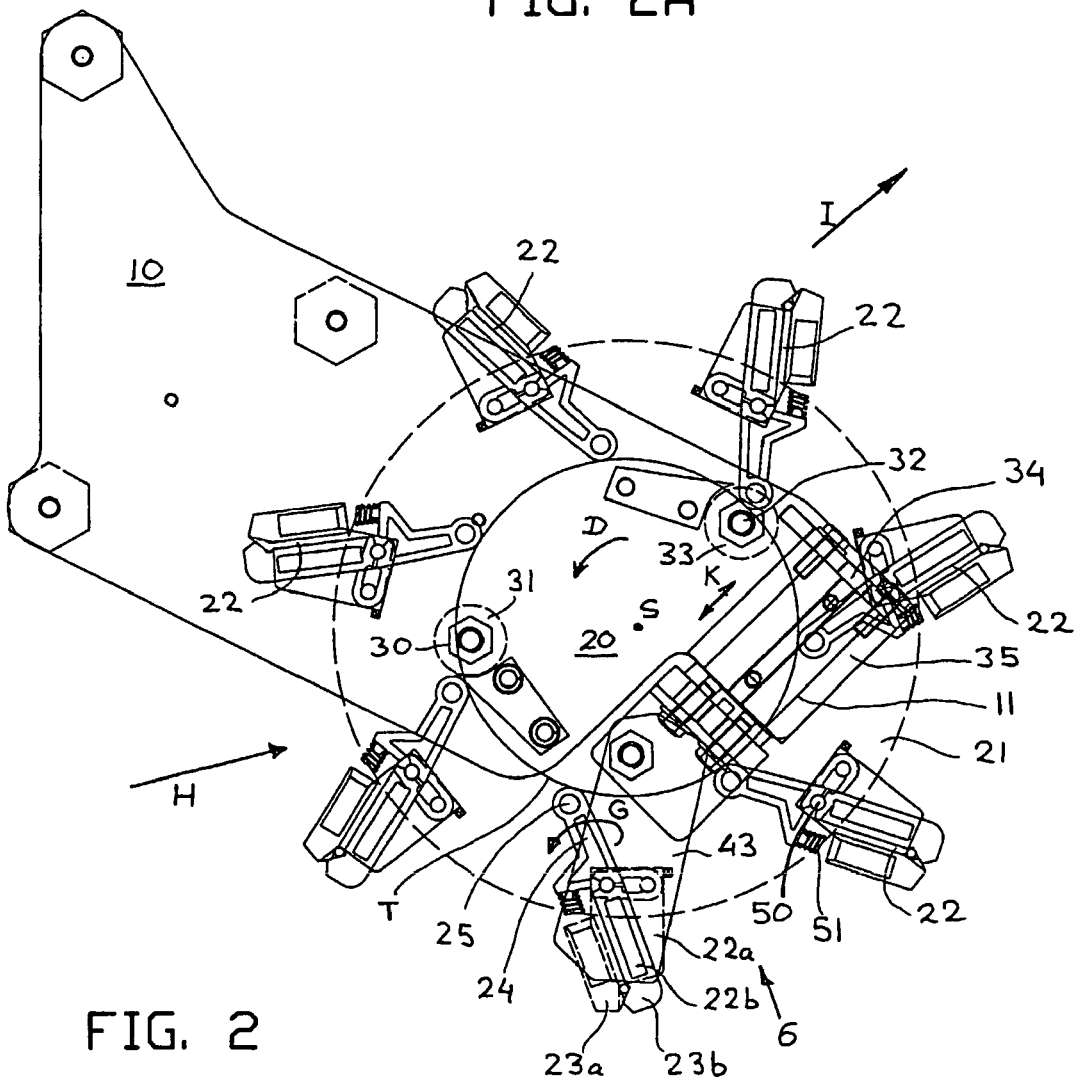
FIG. 2 shows a part according to the invention in the device of FIG. 1.
Figure 3A:
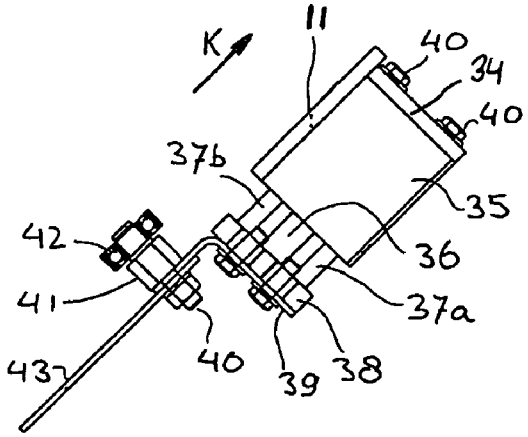
FIG. 3A shows a detail of FIG. 3 corresponding with the detail of FIG. 2A.
Figure 3:
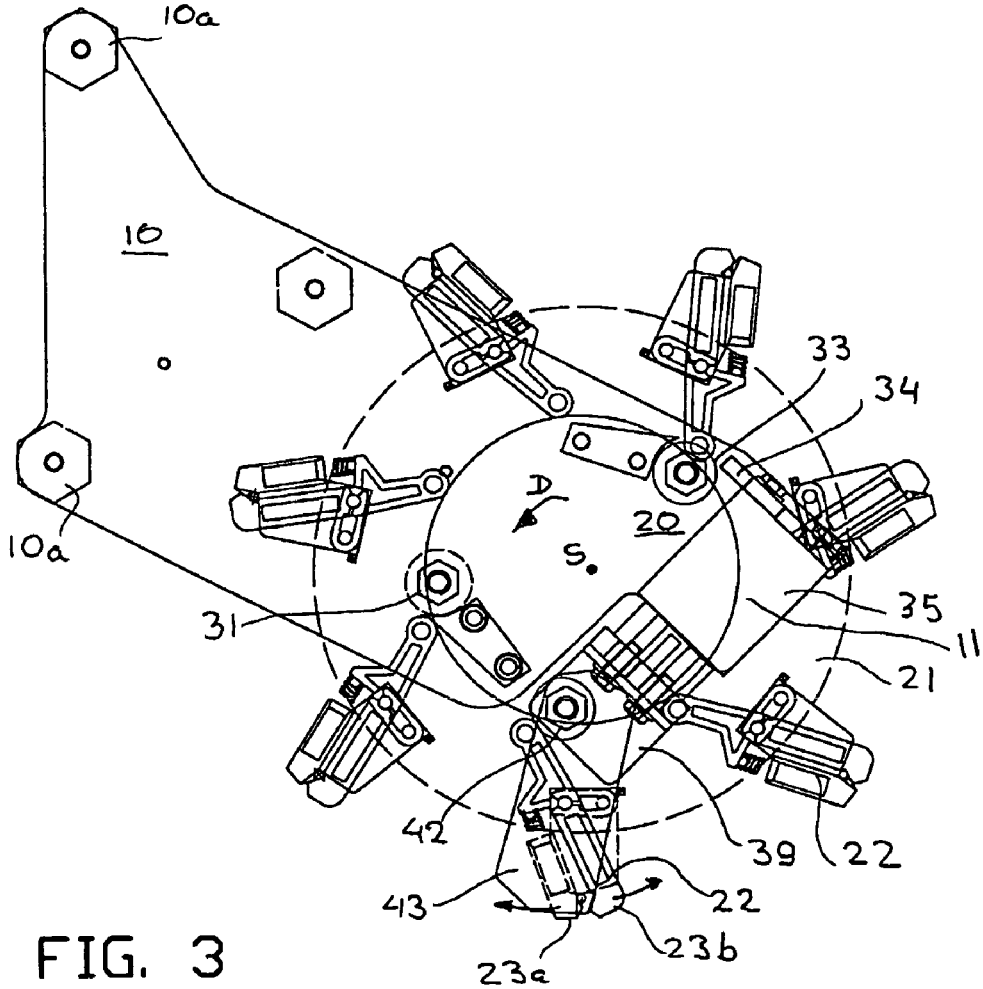
FIG. 3 shows the part of FIG. 2 in an operative position according to the invention.

The packaging machine 1 for lollipops shown in FIG. 1, comprises a frame 2, in which among others are arranged a sorting and distribution disk 3 driven about a vertical centre line S in the direction A, on which disk lollipops supplied in bulk are singled in the manner known per se. The distribution disk has approximately forty-eight to sixty positions. For removing the lollipops from the distribution disk 3 a removal roller 4 is arranged, which rotates in the direction B and has four positions.

From the removal roller 4 the lollipops are transferred to a first transfer disk 5 driven in direction C, which in this example has twenty-five positions. Downstream of the first transfer disk 5 a second transfer disk 6 is arranged, rotating in the direction D, and which in this example has seven positions. Downstream of the second transfer disk 6 a third transfer disk 7 has been placed, which has four positions and is rotated in the direction E. From the third transfer disk 7 the lollipops are transferred to a drum 8, which is rotated in the direction F and in which the lollipops are enveloped with foil material supplied to them for packaging. The packaged lollipops are discharged to a discharge wheel 9 rotating in the direction G and discharging the packaged lollipops to for instance a discharge chute (not shown).

In this example the first and second and third transfer disks 5, 6 and 7 for forming the positions are provided with stick clamps, with which the sticks of the lollipops can be clamped. On each the transfer disks 5, 6 and 7 means are provided for opening the stick clamps when receiving a stick of a lollipop and when discharging it. The stick clamp comprise a stationary clamping arm and an operable clamping arm, which under spring tension is biased to a closed position. By using the stick clamps secured on the disks the positioning of the sticks will be optimally known and said position is for instance not affected by a possible non-circular, such as oval, cross-section of the sticks.

In case a defect occurs at the packaging drum 8, particularly in the foil supply or foil processing, an ejection provision according to the invention is provided at the location of the second transfer disk 6. Said provision can be seen in further detail in the FIGS. 2, 2A, 3 and 3A.

Figure 4:
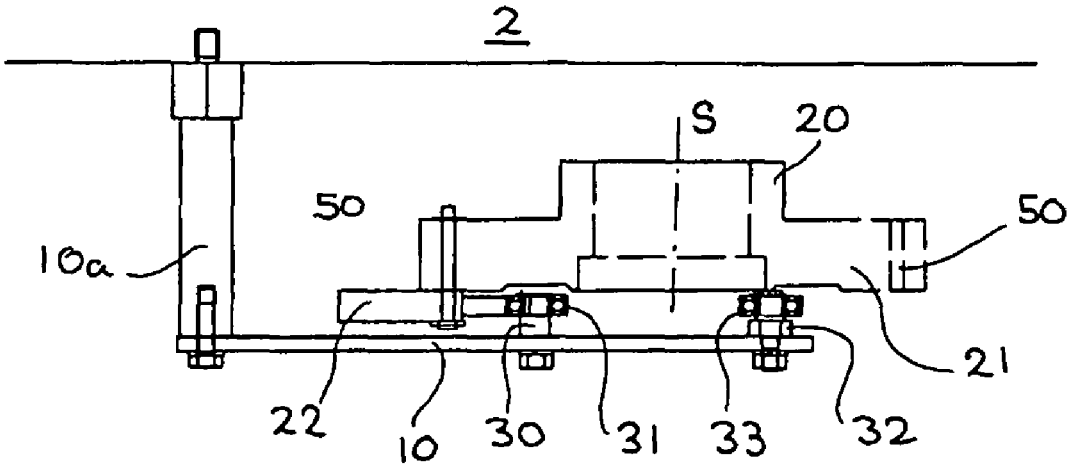
FIG. 4 shows a schematic view in cross-section of a portion of the part of FIG. 2.

Referring to FIG. 4 the transfer disk 6 comprises a wheel 20 having an edge area of flange 21, in which edge area in this example seven stick clamps 22 have been secured. In a manner that is not further shown the wheel 20 is rotatably attached to a plate 10, which plate by means of a number of outriggers 10*a* is attached to the frame 2. The drive means for the disk 6 are not shown.

The stick clamps 22 comprise a rotation-fixed/stationary arm 22*a* attached on the flange 21 and a clamping arm 22*b* rotatable about hinge 50. Clamping arms 22*a*, 22*b* are provided with clamping heads 23*a*, 23*b*, respectively, and are biased towards each other by means of spring 51. The clamping arm 22*b* is extended into a lever 24, having an operation end 25.

At two fixed positions cam rollers 31, 33 are attached on the disk 20 by means of axles 30, 32, which cam rollers 31, 33 extend into the path of the operation ends 25 of the stick clamps 22, when they circulate along with the disk 20 in the direction D. In this way it is achieved that at the location of the supply H (of the first transfer disk 5) the lever 24 is rotated by the cam roller 31 in order to bring the clamping heads 23*a*, 23*b* at a distance from each other, large enough for accommodating a stick therein. After the operation end 25 has been released from the cam roller 31 closing will take place under spring action of the spring 51 between the clamping heads 23*a*, 23*b*, after which the stick is firmly held.

Arriving at the cam roller 33 a same process takes place, in this case to be able to have a stick removed in the direction I, by stick clamps on the third transfer disk 7.

In order to be able to interrupt the supply of lollipops to the drum 8 a third cam roller 42 (FIG. 2A) is provided on the transfer disk 6, which cam roller is rotatable about an axle 41. In the situation shown in FIG. 2 the cam roller 42 is outside the path of movement of the operation ends 25 of the stick clamps 22.

For movement of the cam roller 42 to an operative position a short-stroke cylinder 35 is provided, that is fixedly attached to plate 34 by means of bolts 40, which plate 34 is fixedly attached to end portion 11 of the mounting plate 10. A central piston rod 36 extends from the cylinder 35, having guide rods 37*a,b* on either side thereof. At their ends the rods 36, 37*a,b* are attached to a plate 38, on which by means of bolts 40 an angle plate 39 is attached. The axle 41 and thus the cam roller 42 are attached on the turned leg of the angle plate 39. The whole is shielded in transverse direction by a plate 43. The cylinder 35, and the piston rod 36 together form an actuator for the ejector.

When the supply of lollipops to the drum 8 has to be stopped the cylinder 35 is actuated, as a result of which the piston rod 36 is extended in the direction K, and the cam roller 42 is extended in order to start extending, to a degree corresponding with those of the cam rollers 31 and 33, into the path of movement of the operation ends 25 of the stick clamps 22. The result is that the stick previously held in the stick clamp 22 is able to fall freely out of the space between the clamping heads 23*a*, 23*b*, in the direction L, optionally guided and shielded from the stick clamps on the first disk 5 by plate 43, in order to be optionally collected in a collection tray. Meanwhile the device remains operative, wherein the lollipops coming out of the drum 8 can be discharged as waste via discharge wheel 9. When there are no more lollipops in the drum 8 the device can be switched off and the defect can be repaired. Up until that moment the ejector has been operative. The rod 36 is then retracted again into the cylinder 35 in order to render the cam roller 42 ineffective again prior to restarting the supply process.

The location of operation for said extra opening possibility of the stick clamps 22 is chosen depending on the surrounding of the machine. By letting the opening take place in a downward trajectory or at the lower end thereof, ejection is enhanced.

The invention claimed is:

1. A device for transferring candy articles from a feed location to an exit location spaced apart therefrom, comprising:

at least one conveyor having candy article transporters; and ejection means positioned between the feed location and the exit location for removing the candy articles from the candy article transporters upstream from the exit location in case of a defect at the device;

wherein the ejection means is activated in response to a defect at the device for transferring candy articles occurring.

2. The device of claim 1, wherein the ejection means comprise an actuator which is selectively operable to bring the ejection means in an active position, when required.

3. The device of claim 1, further comprising:

a plurality of consecutively placed conveyors including the at least one conveyor, wherein the at least one conveyor has a reception location and a discharge location;

feed means at the reception location of the at least one conveyor for placing a candy article into the candy article transporters; and exit means at the discharge location of the at least one conveyor for releasing the candy article and discharging the candy article from the candy article transporters for optional further conveyance to the exit location;

wherein the ejection means are arranged between the reception location and the discharge location.

4. The device of claim 3, wherein the reception location of the at least one conveyor is spaced apart from the feed location.

5. The device of claim 3, wherein the discharge location of the at least one conveyor is spaced apart from the exit location.

6. The device of claim 1, wherein the conveyor includes a circulating driven wheel having candy article transporters arranged thereon at its circumference.

7. The device of claim 6, wherein the wheel is provided with notches at its circumference for partially enclosing a lollipop and with confining means for stopping the lollipop radially to the outside.

8. The device of claim 1, wherein the ejection means are adapted for movement of at least a part of the confining means between a position confining the lollipops and a position releasing the lollipops.

9. The device of claim 1, wherein the candy article transporters include candy article holders that move along with the conveyor.

10. The device of claim 9, wherein the feed means include first operation means for setting the candy article holders in a receiving position to receive the candy articles;

the exit means include second operation means for setting the candy article holders in a discharge position to discharge the candy articles to the exit location; and the ejection means include third operation means positioned between the first and the second operation means for, upstream from the second operation means, setting the candy article holders in a discharge position.

11. The device of claim 10, wherein the third operation means are positioned for moving between an operative position extending in the path of movement of the candy article holders and an inoperative position situated outside of the path of movement of the candy article holders.

12. The device of claim 10, wherein the candy article holders include candy article clamps having first and second clamping arms movable with respect to each other;

the first, second, and third operation means are operative to move the clamping arms with respect to each other including away from each other;

the candy article holders are provided with biasing means for biasing the clamping arms towards each other; and the first, second, and third operation means are operative counter the biasing means.

13. The device of claim 12, wherein the first clamping arm is fixedly positioned and the second clamping arm is movable, wherein the third operation means form a run-on surface for the second clamping arm.

14. A device for transferring candy articles from a feed location to an exit location spaced apart therefrom, comprising:

at least one conveyor with candy article holders;

first operation means at a reception location of the at least one conveyor for setting the candy article holders in a receiving position to receive the candy articles;

second operation means at a discharge location of the at least one conveyor for setting the candy article holders in a discharge position to discharge the candy articles; and selectively actuatable third operation means positioned between the reception location and the discharge location for, upstream from the discharge location, setting the candy article holders in a discharge position in case of a defect in the device.

15. The device of claim 14, wherein the third operation means are positioned for moving between an operative position extending in the path of movement of the candy article holders and an inoperative position situated outside of the path of movement of the candy article holders.

16. The device of claim 14, wherein the candy article holders include candy article clamps having first and second clamping arms movable with respect to each other;

the first, second, and third operation means are operative to move the clamping arms with respect to each other, including away from each other;

the candy article holders are provided with biasing means for biasing the clamping arms towards each other; and the first, second and third operation means are operative counter the biasing means.

17. The device of claim 16, wherein the first clamping arm is fixedly positioned and the second clamping arm is movable.

18. The device of claim 14, wherein the reception location is spaced apart from the feed location.

19. The device of claim 14, wherein the reception location corresponds with the feed location.

20. The device of claim 14, wherein the discharge location is spaced apart from the exit location.

21. The device of claim 14, wherein the discharge location corresponds with the exit location.

22. The device of claim 14, wherein the candy article transporters are adapted for engaging lollipop sticks so as to take them along.

23. The device of claim 14, wherein the at least one conveyor has a down-going trajectory in its circumferential path between the reception location and the discharge location, wherein one of the ejection means and the third operation means are positioned to be active at the location of the down-going trajectory.

24. The device of claim 14, wherein the at least one conveyor is positioned in a series of conveyors.

25. The device of claim 14, wherein the at least one conveyor is placed as a second conveyor between a first and a third conveyor, wherein consecutive conveyors are driveable circulating in opposite directions.

26. The device of claim 14, further comprising:

a distributing/sorting disk having a vertical axis of rotation and positioned at the location of the feed location.

27. The device of claim 14, further comprising:

a packaging station for enveloping the candy articles in sheets.

28. The device of claim 14, further comprising a twist head of a packaging machine having a horizontal axis of rotation and positioned at the location of the exit location.

29. A conveyor for conveying candy articles in series from a feed location to a discharge location, the conveyor comprising:

a series of candy article transporters that are moved according to a circulation, wherein the candy article transporters are movable between an open position, enabling receipt or release of a candy article, and a confining position, in which the candy article is held for conveying the candy article; and an opener which is selectively operable for consecutively bringing the candy article transporters in the open position for removal of the candy articles in response to a defect occurring in a candy transferring device, and otherwise allowing the candy article transporters to remain in the confining position.

30. The conveyor of claim 29, wherein the opener comprises an obstacle that is movable between an inactive position not interfering with the candy article transporters and an active position interfering with the candy article transporters for bringing the candy article transporters in the open position.

31. The conveyor of claim 29, wherein the opener is stationary with respect to the path followed by the candy article transporters.

32. The conveyor of claim 29, wherein the conveyor circulates in a substantially vertical plane.

33. The conveyor of claim 29, further comprising:

a wheel or disk on which the candy article transporters are disposed.

34. The conveyor of claim 29, wherein the candy article transporters are adapted for taking along lollipops.

35. A device for transferring lollipops from a feed location to an exit location spaced apart therefrom, comprising:

at least one conveyor having lollipop holders for conveying single lollipops in series; and a selectively operable opener, positioned between the feed location and the exit location for opening the lollipop holders upstream from the exit location to remove the lollipops therefrom;

wherein the opener is configured to open the lollipop holders is response to detection of a defect at a candy transferring device.

* * * * *